United States Patent [19]

Deppendorf et al.

[11] Patent Number: 4,765,024

[45] Date of Patent: Aug. 23, 1988

[54] RECESSED HINGE

[75] Inventors: Hans-Dieter Deppendorf, Vlotho; Manfred Grossmann, Enger, both of Fed. Rep. of Germany

[73] Assignee: Oni-Metallwarenfabriken Günter GmbH & Co., Vlotho, Fed. Rep. of Germany

[21] Appl. No.: 74,927

[22] Filed: Jul. 17, 1987

[30] Foreign Application Priority Data

Jul. 24, 1986 [DE] Fed. Rep. of Germany ... 8619865[U]

[51] Int. Cl.[4] ..... E05D 11/00

[52] U.S. Cl. ..... 16/251; 16/86 A; 16/379

[58] Field of Search ..... 16/86 R, 86 A, 86 B, 16/86 C, 250, 251, 379, DIG. 17; 49/398

[56] References Cited

U.S. PATENT DOCUMENTS 2,557,716 6/1951 Allee ..... 16/250

FOREIGN PATENT DOCUMENTS 1189260 6/1985 Canada ..... 16/250

2234700 1/1974 Fed. Rep. of Germany ..... 16/250

*Primary Examiner*—Nicholas P. Godici

*Assistant Examiner*—Richard K. Seidel

*Attorney, Agent, or Firm*—Peter K. Kontler

[57] ABSTRACT

A recessed hinge wherein a socket is installed in the pivotable door of a piece of furniture and an arm is attached to a stationary wall of the piece of furniture. The socket contains a pintle which connects the socket to the arm, and the socket has an open side which is concealable by a closure pivotally connected to the arm by a pin which is parallel to the pintle. The closure overlies the open side of the socket in the closed position of the door, and it arrests the door when the latter reaches its fully open position. Two extensions of the closure extend into the socket and engage abutments in the socket when the door is closed. The closure can be made of an elastomeric material.

12 Claims, 2 Drawing Sheets

Fig. 4
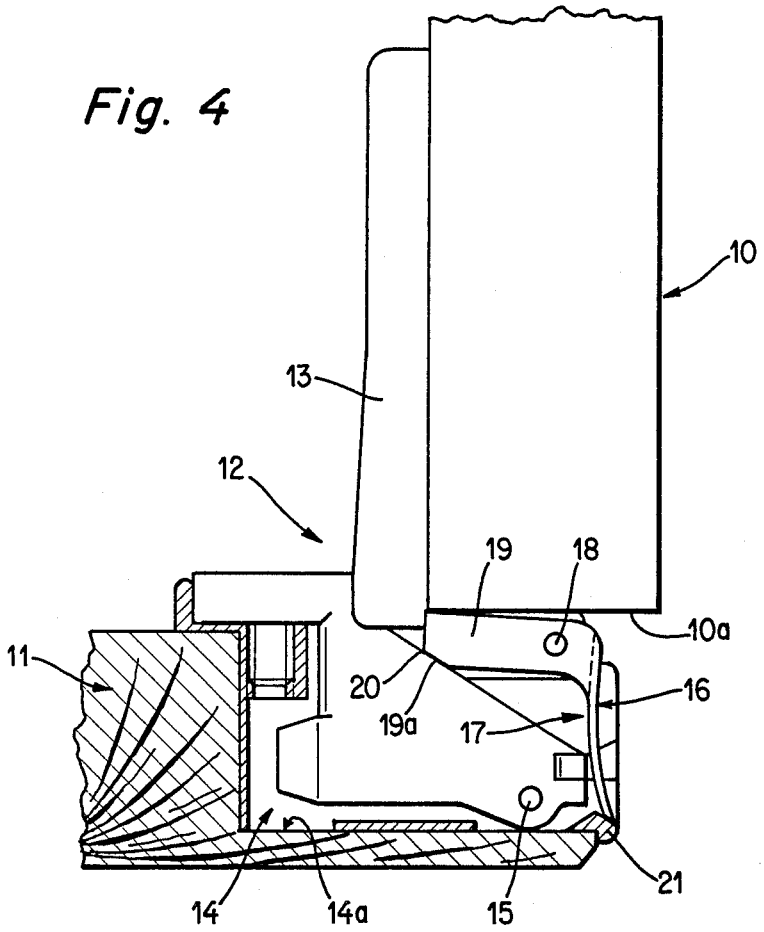
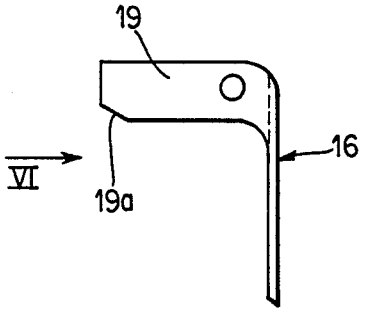
Fig. 5
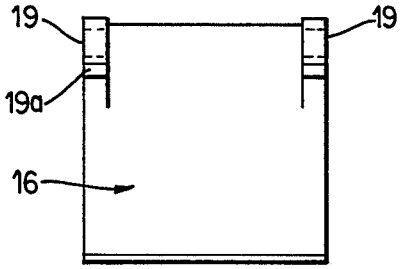
Fig. 6

RECESSED HINGE

BACKGROUND OF THE INVENTION

The invention relates to hinges in general, and more particularly to improvements in so-called recessible or recessed hinges wherein one component of the hinge extends into the other component and the other component can be recessed into a part of a piece of furniture or the like, for example, into a door which is to be pivotably mounted on a wall or another stationary part of a piece of furniture.

It is already known to install a socket-like first or female component of a single-joint hinge in a pivotable door, to attach an arm-like second or male component of the hinge to a stationary part (e.g., a wall) of a piece of furniture or to a door frame, and to provide in the first component a pintle about which the first component can pivot with reference to second component in order to enable the door to move between its open and closed positions. Such relatively simple and inexpensive hinges occupy little room and are nearly completely concealed. However, the chamber or recess in the first component remains accessible by way of an open side which is needed to allow for pivotal movement of the first component with reference to the second component, namely to ensure that the second component cannot interfere with movements of the door between its fully open and closed positions. The open side is accessible at least when the door is closed and it then allows dust and/or other foreign matter to penetrate into the chamber of the first component. Moreover, this detracts from the appearance of the hinge.

Attempts to avoid the use of a female component with an open side which is accessible in the closed position of the door include the provision of a wall which is integral with the female component and takes the place of the open side.

Such modification necessitates the utilization of a relatively tall or high male component in order to ensure that the female component can pivot with the door at a level above the male component. This not only contributes to the bulk and cost but also detracts from the appearance of the hinge.

OBJECTS AND SUMMARY OF THE INVENTION

An object of the invention is to provide a novel and improved recessed or recessible hinge, particularly a single-joint hinge, which is constructed and assembled in such a way that the presence of an open side in its female component does not detract from its appearance, at least when the open side would normally be visible in the closed position of a mobile part which is hingedly connected to a stationary part.

Another object of the invention is to provide the hinge with novel and improved means for concealing the open side of the female component of the hinge and wherein such concealing means can also perform at least one additional important and desirable function.

A further object of the invention is to provide a hinge wherein the means for concealing the open side of the female component can be used to limit the movability of the pivotable component, at least in one of two directions.

An additional object of the invention is to provide novel and improved male and female components and other parts which can be utilized in the above outlined hinge.

Still another object of the invention is to provide a novel and improved mode of concealing the open side of a recessed or recessible component in a single-joint hinge for use on or in pieces of furniture and for similar or analogous purposes.

The invention is embodied in a hinge which can be recessed, at least in part, into a piece of furniture or the like. For example, the hinge can constitute a so-called single-joint hinge which can be used to connect a movable part (e.g., a door) of a piece of furniture with a stationary part (e.g., a wall). The improved hinge comprises a hollow first component which can be recessed into one of the stationary and movable parts and has an open side, a second component which is connectable to the other of the stationary and movable parts, means for movably coupling the components to each other including a pintle which is provided in the first component and defines a first pivot axis for pivotal movement of one of the components relative to the other component to and from a predetermined position in which the aforementioned open side of the first component is exposed, a closure for the open side of the first component, and means for articulately connecting the closure to the first component including a pivot member (such as a pin or shaft) which is provided on the second component and defines for the closure a pivot axis at least substantially parallel to the first axis. The closure includes a portion (e.g., in the form of a flap) which overlies the open side of the first component in the predetermined position of the one component (such predetermined position can be that position in which the movable piece of furniture is maintained in closed position).

The first component defines a chamber for a portion of the second component and for the coupling means, and the open side affords access to the chamber. The hinge can further comprise at least one extension which is movable with the closure and is located in the chamber, at least when the one component assumes the predetermined position. At such time, the extension preferably engages and is located in a preselected position by an abutment in the chamber of the first component. The extension is or can be integral with the closure. In accordance with a presently preferred embodiment, the hinge is constructed in such a way that the closure has two extensions which flank the first component and each of which engages a discrete abutment in the chamber of the first component when the one component assumes its predetermined position.

The closure is or can be at least slightly elastic; for example, a portion at least of the closure can be made of a suitable elastomeric plastic material.

As mentioned above, the first component is preferably pivotable with reference to the second component between the aforementioned predetermined position (preferably corresponding to closed position of the door if the first component is recessed into a door) and a second position in which the door is fully open. The closure can include a portion (particularly a portion which is remote from the second pivot axis) which arrests the first component in the second position, i.e., the second component is held against further pivotal movement away from its predetermined position. The first component can constitute a socket and the second component can include or constitute an arm which is affixed to the respective part of the piece of furniture and a portion of which extends into the socket. The open side of the socket enables the latter to pivot with reference to the arm when the door is pivoted to its open position.

The novel features which are considered as characteristic of the invention are set forth in particular in the appended claims. The improved hinge itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 4 is an enlarged view of the structure of FIG. 1, with the movable part and the hollow component of the hinge partly broken away;

FIG. 5 shows the closure of the improved hinge in a position corresponding to that of FIG. 1 or 4; and FIG. 6 is a view of the closure as seen in the direction of arrow VI in FIG. 5.

DESCRIPTION OF THE PREFERRED EMBODIMENTS

Figure 1:
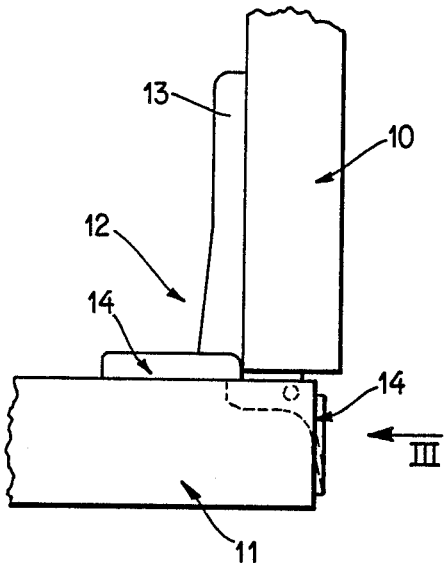
FIG. 1 is a schematic plan view of a stationary and of a pivotable part of a piece of furniture wherein such parts are connected to each other by a hinge embodying the present invention, the movable part of the piece of furniture being shown in closed position.

Referring first to FIGS. 1 and 4, there is shown a portion of a piece of furniture, e.g., a cabinet, which includes a stationary part 10 in the form of an upright wall and a movable part 11 in the form of a door which is located in a vertical plane and is shown in closed (predetermined) position in which its plane extends substantially at right angles to the plane of the stationary wall 10. The door 11 is pivotable with reference to the wall 10 about a vertical axis which is defined by a coupling device in the form of an upright pintle 15 forming part of a novel and improved single-joint recessed hinge 12. The latter comprises a hollow first (female) component 14 which is a metallic or plastic socket recessed into the inner side of the door 11 and having a chamber 14*a* (FIG. 4) with an open side 17 facing to the right, as seen in FIG. 1. The second or male component 13 of the hinge 12 is an arm which is affixed to the inner side of the wall 11 and a portion of which extends into the chamber 14*a* to carry the pintle 15 and to thus allow the socket 14 and the door 11 to pivot between the closed (predetermined) position of FIG. 1 and the second or open position shown in FIG. 2. The open side 17 is necessary in order to enable the socket 14 to pivot with reference to the arm 13 between the positions which are shown in FIGS. 1 and 4 on the one hand and the position of FIG. 2 on the other hand.

In accordance with a feature of the invention, the open side 17 of the chamber 14*a* in the socket 14 is overlapped and concealed by a flap-like closure 16 which is mounted on the arm 13 of the hinge 12 for pivotal movement about or with a pin- or shaft-like connecting element 18 provided in or on the arm 13 and defining a pivot axis which is parallel to but spaced apart from the axis defined by the pintle 15. The closure 16 overlies the open side 17 when the door 11 is caused or allowed to assume the closed position of FIGS. 1 and 4. The connecting element 18 is disposed between the pintle 15 and the adjacent narrow end face 10*a* of the wall 10 and is mounted on or forms an integral portion of that section of the arm 13 which extends along the end face 10*a*.

Figure 2:
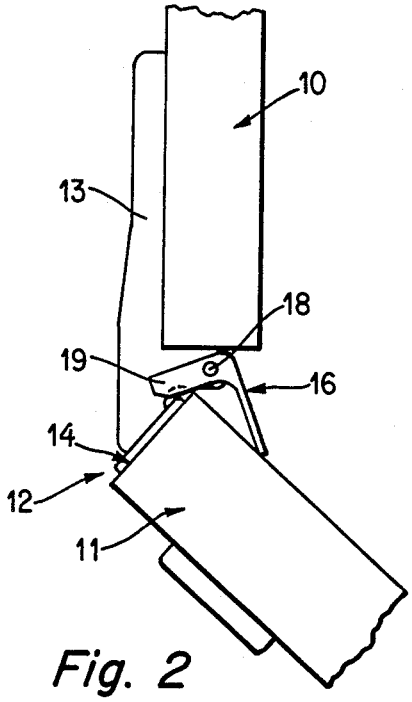
FIG. 2 shows the structure of FIG. 1 but with the movable part of the piece of furniture in open position.
Figure 3:
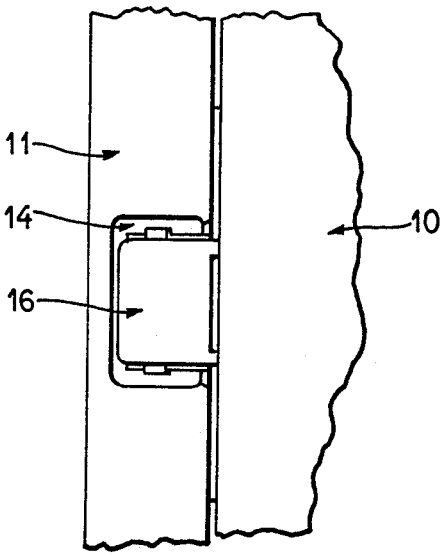
FIG. 3 is an end elevational view as seen in the direction of arrow III in FIG. 1.

FIGS. 3 and 6 shows that the closure 16 is provided with two extensions 19 in the form of substantially parallel arms which flank the arm 13 of the hinge 12 and extend into the chamber 14*a* of the socket 14. The latter is provided with abutments 20 which are disposed in the chamber 14*a* and serve as stops for the adjacent edge faces 19*a* of the arms 19 to locate the closure 16 in the operative position of FIGS. 1 and 4, namely in the position in which the closure overlies the open side 17 of the chamber 14*a*. The configuration of one of the extensions or arms 19 is further shown in FIG. 5. These arms ensure that the closure 16 is fixed in the operative position of FIGS. 1 and 4 as long as the door 11 remains closed. On the other hand, the closure 16 is free to pivot about the axis of the connecting element 18, so as not to interfere with pivoting of the socket 14 relative to the adjacent portion of the arm 13, when the door 11 is caused to pivot toward the open position of FIG. 2.

As can be seen in FIG. 2, the closure 16 can perform an additional desirable and advantageous function, namely that of a means for arresting the door 11 in the open position. To this end, the closure 16 is then wedged between the end face 10*a* of the wall 10 and the outer side of the door 11 to prevent further counterclockwise movement of the door about the axis of the pintle 15.

In accordance with a presently preferred embodiment of the invention, the extensions 19 constitute integral parts of the closure 16, and the latter is or can be made of an elastomeric plastic material which is transparent, translucent or opaque and which can act not unlike an elastic damper to bring about a gradual stop to further angular movement of the door 11 from its closed position. The major part of the closure 16 can constitute a relatively thin flap or plate which can undergo at least some elastic deformation when it is contacted and moved by the outer side of the door 11. At least some elasticity of the closure 16 is desirable on the additional ground that its portion which serves as a means for arresting the door 11 against movement beyond the open position of FIG. 2 can also serve as an elastic lip which bears against the adjacent marginal portion 21 of the socket 14 when the door 11 is held in the closed position of FIGS. 1 and 4. This can entail a practically fluidtight sealing of the chamber 14*a* from the surrounding atmosphere. Moreover, such elasticity of the closure 16 is desirable and advantageous on the ground that the elastic flap-like part of the closure can adequately overlie and even seal the open side 17 of the chamber 14*a* even if the socket 14 and/or the closure is not machined and/or otherwise finished with a high degree of precision, i.e., the elastic closure 16 can compensate for machining tolerances or for those tolerances which develop in an extruding or other mass producing machine.

It will be seen that the closure 16 can perform at least two important and desirable functions, namely of closing or even sealing the open side 17 of the chamber 14*a* when this open side is most accessible (in the closed position of the door 11), and of serving as a means for arresting the door 11 in the fully open position of FIG. 2. Still further, the closure 16 cooperates with the abutments 20 to ensure that the open side 17 will remain concealed as long as the door 11 is held in the closed position, and the closure can compensate for machining or other manufacturing tolerances. Proper sealing or concealment of the open side 17 of the chamber 14*a* enhances the appearance of the hinge 12 and of the piece of furniture in which the hinge is put to use and, furthermore, such sealing or concealment of the open side 17 prevents rapid contamination of the chamber 14*a* and eventual blocking of angular movements of the door 11 between its open and closed positions. If the closure 16 is at least slightly elastic, it further performs the desirable function of cushioning the last stage of movement of the door 11 to its fully open position.

The closure 16 can be modified by omitting one of the extensions 19; however, two extensions are preferred at this time because the forces which develop when the extensions bear against the respective abutments 20 are distributed to act at both sides of the arm 13, and the same holds true when the closure 16 is held in the position of FIG. 2 and serves as a cushion and a means for arresting the door 11 in the open position.

A further important advantage of the closure 16 and of the improved hinge 12 is that the closure renders it possible to reduce the dimensions of the arm 13 and of the entire hinge because the open side 17 of the chamber 14*a* can remain but its presence does not adversely affect the appearance and/or the operation of the hinge and/or the operation of the piece of furniture in which the hinge is put to use. Thus, the designer can disregard the presence of the open side 17 by the expedient of adding an extremely simple, compact and inexpensive closure 16 which not only conceals the open side 17 when the door 11 is closed but also serves as a means for arresting the door in the open position. The provision of a relatively small and compact hinge is desirable and advantageous in most instances because this renders the hinge less conspicuous and necessitates the making of a relatively shallow groove in the door 11 to confine the socket 14. The movements of the socket 14 relative to the arm 13 of the hinge 12 are as unobstructed as if the closure 16 were absent; nevertheless, the side 17 of the chamber 14*a* is automatically concealed and even sealed as soon as the door 11 is pivoted back to the position shown in FIGS. 1 and 4.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A recessed hinge, particularly a single-joint recessed hinge for connecting a movable part of a piece of furniture with a stationary part, comprising a hollow first component arranged to be recessed into one of the stationary and movable parts and having an open side; a second component arranged to be connected to the other of the stationary and movable parts; means for movably coupling said components, including a pintle provided in said first component and defining a first pivot axis, one of said components being pivotable about said axis to and from a predetermined position in which said side of the first component is exposed; a closure for said side of said first component; and means for articulately connecting said closure to said second component, including a pivot member provided on said second component and defining for said closure a second pivot axis substantially parallel to said first axis.

2. The hinge of claim 1, wherein said closure includes a portion which overlies the open side of said first component in said predetermined position of said one component.

3. The hinge of claim 1, wherein said first component has a chamber for said coupling means and said open side affords access to said chamber, and further comprising at least one extension movable with said closure, adjacent said second component and located in said chamber, at least in said predetermined position of said one component.

4. The hinge of claim 3, further comprising an abutment in said chamber, said extension engaging said abutment to maintain the closure in a predetermined position in said predetermined position of said one component.

5. The hinge of claim 3, wherein said extension is integral with said closure.

6. The hinge of claim 1, wherein said first component has a chamber for said coupling means and said open side affords access to said chamber, and further comprising two extensions movable with said closure, flanking said second component and located in said chamber, at least in said predetermined position of said one component.

7. The hinge of claim 6, further comprising abutments provided in said chamber, said extensions engaging said abutments to maintain said closure in a predetermined position with reference to said open side in the predetermined position of said one component.

8. The hinge of claim 6, wherein at least one of said extensions is integral with said closure.

9. The hinge of claim 1, wherein at least a portion of said closure is elastic.

10. The hinge of claim 1, wherein said first component is pivotable with reference to said second component between said predetermined position and a second position, said closure including a portion which arrests the first component in said second position against further pivotal movement from said predetermined position.

11. The hinge of claim 1, wherein said first component is a socket which is arranged to the recessed into the movable part and said second component includes an arm which is arranged to be affixed to the stationary part of a piece of furniture.

12. The hinge of claim 1, wherein at least a portion of said closure consists of an elastomeric plastic material.

* * * * *